US006364548B1

(12) United States Patent
Todoki

(10) Patent No.: US 6,364,548 B1
(45) Date of Patent: Apr. 2, 2002

(54) TRANSFER APPARATUS FOR TRANSFERRING PRE-PROCESSED SHEET MATERIALS, AND PHOTOGRAPHIC PROCESSING APPARATUS USING THE SAME

(75) Inventor: Kenji Todoki, Wakayama (JP)

(73) Assignee: Noritsu Koki Co., Ltd., Wakayama (JP)

( * ) Notice: Subject to any disclaimer, the term of this patent is extended or adjusted under 35 U.S.C. 154(b) by 0 days.

(21) Appl. No.: 09/461,471

(22) Filed: Dec. 14, 1999

(30) Foreign Application Priority Data

Dec. 17, 1998 (JP) ..... 10-359548

(51) Int. Cl.[7] ..... G03D 3/08

(52) U.S. Cl. ..... 396/612; 396/615; 271/287; 271/302; 399/405

(58) Field of Search ..... 355/75, 76, 27–29; 396/612, 615, 618; 271/9, 11, 287, 291, 295; 399/403, 405

(56) References Cited

U.S. PATENT DOCUMENTS

| | | | | |
|---|---|---|---|---|
| 4,277,061 A | * | 7/1981 | Nagel et al. | 271/302 |
| 4,324,480 A | * | 4/1982 | Nomura et al. | 396/618 |
| 4,420,153 A | * | 12/1983 | Winkler et al. | 271/304 |
| 4,518,161 A | * | 5/1985 | Nakamura | 271/303 |
| 5,331,389 A | * | 7/1994 | Kukuchi et al. | 271/287 |
| 5,499,806 A | * | 3/1996 | Bourg | 271/9.11 |
| 6,134,418 A | * | 10/2000 | Kato et al. | 399/405 |

* cited by examiner

*Primary Examiner*—D Rutledge
(74) *Attorney, Agent, or Firm*—Fulbright & Jaworski L.L.P.

(57) ABSTRACT

A transfer apparatus for transferring pre-processed sheet materials discharged from an outlet of a sheet processing apparatus includes a transfer unit provided outside of the outlet for receiving the sheet materials discharged from the outlet and transferring the sheet materials to a plurality of collecting sites. The transfer unit is capable of selectively shifting the transfer direction thereof in such a manner as to transfer each of the sheet materials to a predetermined collecting site.

16 Claims, 6 Drawing Sheets

TRANSFER APPARATUS FOR TRANSFERRING PRE-PROCESSED SHEET MATERIALS, AND PHOTOGRAPHIC PROCESSING APPARATUS USING THE SAME

BACKGROUND OF THE INVENTION

1. Field of the Invention

The present invention relates to a transfer apparatus for transferring pre-processed sheets discharged from an outlet of a sheet-processing apparatus such as a photographic processing apparatus and a copying apparatus.

2. Discussion of the Background

According to a conventional photographic processing apparatus, a strip of photosensitive material is cut to sheets of a predetermined length by a cutter or the like. After cutting operation, film images on a negative film are respectively exposed onto the photosensitive material sheets, which are then transferred to a developing station to be developed, bleached, fixed and stabilized. These processes will be generically named "developing process". The developed photosensitive material sheets are transferred to a drying unit to be dried, and subsequently to a collecting unit such as a tray to be properly collected or stacked thereon.

For collecting on the collecting unit, the photosensitive material sheets are usually sorted and held in a pile for every size, or every customer's order. Customer's orders generally include a simultaneous printing order and an extra printing order. The simultaneous printing order means that one or several prints in service sizes or the like for all frame images on a film are ordered simultaneously with the development of the film, and the extra printing order means that one or several prints for a film image in a particular frame on a negative film are ordered. With a recently developed camera using an APS film, images can be shot in various size frames, such as standard size frame, panoramic size frame and high-vision size frame in a single film.

To array photosensitive material sheets (objects to be transferred) according to a size or order thereof on the collecting unit, it is necessary to transfer the objects or dried photosensitive material sheets (i.e., pictures) to the collecting unit by a transfer apparatus having some type of a transfer mechanism.

FIG. 5 illustrates a schematic perspective view of a photographic processing apparatus equipped with a conventional transfer apparatus. FIG. 6 is a schematic perspective view of the transfer apparatus and its proximity in the photographic processing apparatus of FIG. 5. Specifically, the conventional transfer apparatus illustrated in FIGS. 5 and 6 includes a transfer unit 101, a first collecting unit 102 and a second collecting unit 103, in which the transfer unit 101 is constructed by employing a belt conveyor 101*a* that is rotatable in a predetermined direction, and the first collecting unit 102 is constructed by employing a plurality of trays 102*a*. The plurality of trays 102 are rotated in the direction of arrow C' to introduce a new tray into a sheet-receiving position for receiving the photosensitive material sheets for a new order, etc.

According to the arrangement of FIGS. 5 and 6, after being subjected to the drying process, the dried photosensitive material sheets are sorted according to their sizes, and discharged from different outlets, namely a first outlet 111 for a smaller size (e.g., the size of not more than 102 mm (4 inches)) and a second outlet 113 for a larger size (e.g., the size of not less than 127 mm (5 inches)).

The photosensitive material sheets of the smaller size discharged from the first outlet 111 and moved onto the belt conveyor 101*a* of the transfer unit 101 in the direction of arrow A' are transferred to the first collecting unit 102 by rotating the belt conveyor 101*a* in the direction of arrow B'. The photosensitive material sheets in each order are basically placed on each tray of the plurality of trays 102*a* of the first collecting unit 102, and therefore those in a new order is collected on a different tray which has been introduced into the sheet-receiving position by rotating the first collecting unit 102 in the direction of arrow C'.

The photosensitive material sheets of the larger size discharged in the direction of arrow D' from the second outlet 113 are collected on the second collecting unit 103 located right below the second outlet 113.

With the photographic processing apparatus employing the above transfer arrangement, the photosensitive material sheets as the objects to be collected can be properly sorted and collected on the collecting units according to a size, order, etc.

In the photographic processing apparatus with the transfer apparatus as mentioned above, the photosensitive material sheets are subjected to the sorting operation as they are transferred, thereby properly collecting them in the first collecting unit 102 closer to the first outlet 111 and the second collecting unit closer to the second outlet 113 according to their sizes, orders, etc. This conventional transfer arrangement or photographic processing apparatus using the same, however, requires a sorting mechanism to be provided inside of the photographic processing apparatus for sorting the photosensitive material sheets either to the first outlet 111 or the second outlet 113 according to their sizes. This leads to a complicated structure of the apparatus, and therefore increase the manufacturing costs, since a limited inner space of the photographic processing apparatus results in a complicated formation of paths of the photosensitive material sheets, which requires a lot of associated parts, such as a path-switching device, feeding rollers and driving rollers. Moreover, such a limited inner space results in a narrowed path of the photosensitive material sheets, which is likely to cause "chewing up" of the path of the sorting mechanism with the photosensitive material sheets.

It is an object of the present invention to provide a transfer apparatus that is capable of sorting the objects to be transferred according to their sizes, orders, etc., by employing a relatively simple structure.

It is another object of the present invention to provide a photographic processing apparatus having the transfer apparatus of a relatively simple structure.

SUMMARY OF THE INVENTION

To achieve the above objects, there is provided a transfer apparatus for transferring pre-processed sheet materials discharged from an outlet of a sheet processing apparatus including a transfer unit provided outside of the outlet for receiving the sheet materials discharged from the outlet and transferring the sheet materials to a plurality of collecting sites, in which the transfer unit is capable of selectively shifting the transfer direction thereof in such a manner as to transfer each of the sheet materials to a predetermined collecting site.

According to the transfer apparatus of the above arrangement, even in the case where the sheet materials are to be collected at a plurality of collecting sites, it is not necessary to provide a corresponding number of outlets for discharging the sheet materials of different sizes, orders, etc., since the transfer unit capable of transferring the sheet materials to a plurality of collecting units is provided outside of the outlet of the sheet processing apparatus. Specifically, the transfer apparatus of the present invention enables the sheet processing apparatus to omit parts for making up an additional discharging mechanism, which may include feeding rollers, a path switching device, etc., and therefore can obtain a sheet processing apparatus with a relatively simple structure as compared with a conventional apparatus.

The transfer unit of the sheet transfer apparatus preferably includes a belt conveyor for transferring the sheet materials to the plurality of collecting sites located at both sides of the belt conveyor, a driving means for driving the belt conveyor to be rotated in the forward and reverse directions, and a control means for controlling the driving means to selectively shift the rotational direction of the belt conveyor, thereby shifting the transfer direction of the transfer unit.

The above transfer unit allows the sheet transfer apparatus to be effectively arranged. Specifically, the sheet transfer apparatus can include a conventional sensing means for detecting a size, order, etc., of each of the sheet materials, and the control means that controls the driving means in the form of, for example, a conventional DC motor to selectively rotate the belt conveyor in either direction by timely reversing the direction of the drive of the motor by reversing the current to the motor. Thus, the transfer direction of the sheet materials placed on the belt conveyor is selectively shifted, so that the sorting operation of the sheet materials can be accomplished without requiring an additional sorting mechanism. Whereby, it is possible to obtain a sheet transfer apparatus with a relatively simple structure that is capable of sorting the sheet materials according to size, order, etc., of the sheet materials.

According to another aspect of the present invention, there is provided a photographic processing apparatus having a drying unit for drying pre-processed photosensitive material sheets and defining an outlet for discharging the photosensitive material sheets dried in the drying unit therethrough, which includes a transfer unit provided outside of the outlet for receiving the photosensitive material sheets discharged from the outlet and transferring the photosensitive material sheets to a plurality of collecting sites, in which the transfer unit is capable of selectively shifting the transfer direction thereof in such a manner as to transfer each of the photosensitive material sheets to a predetermined collecting site.

With the photographic processing apparatus of the above arrangement, a sorting operation of the photosensitive material sheets can be accomplished by a relatively simple structure.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

Embodiments of a transfer apparatus according to the present invention will be hereinafter described with reference to the accompanying drawings.

Figure 1:
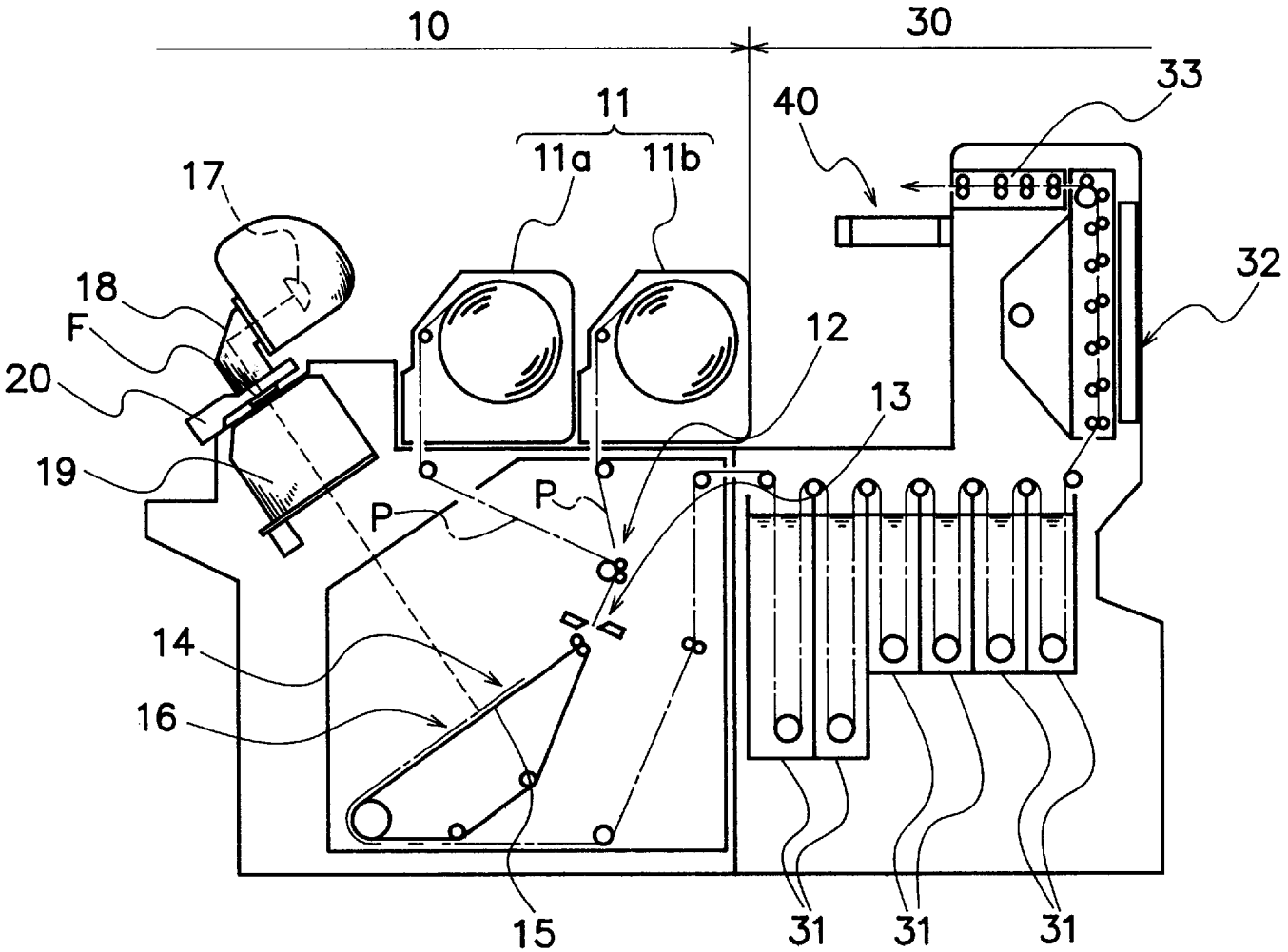
FIG. 1 is a schematic view of the photographic processing apparatus with the transfer apparatus for transferring pre-processed sheet materials according to the present invention.

FIG. 1 is a schematic view of the photographic processing apparatus with the transfer apparatus for transferring pre-processed sheet materials according to the present invention, in which the photographic processing apparatus includes a printing station 10 and a development station 30.

The printing station 10 includes a pair of magazines 11 (first magazine 11*a* and second magazine 11*b*) respectively accommodating photosensitive material in the form of paper rolls, a magazine selecting unit 12 for selecting either one of the magazines 11*a* or 11*b* accommodating the photosensitive material to be processed, a cutter 13 for cutting a strip of the photographic material to sheets of a predetermined length, and an exposing unit 14, in which the photographic sheet materials P are subjected to an exposing operation. In the exposing unit 14, an endless suction belt 15 is wound around rollers, having the shape as a whole and having substantially trapezoidal sides, and endlessly rotated to transfer the photosensitive material sheets P to an exposure stage 16, in which images of a negative film F set on a film carrier 20 are respectively printed onto the photosensitive material sheets P by means of the light radiated from a light source 17 through a mirror tunnel 18, a lens unit 19, etc.

The photosensitive material sheets P with images printed thereon at the printing station 10 are then transferred to the development station 30 via feeding rollers, driving rollers, etc. The development station 30 includes a plurality of tanks 31 with different processing solutions, for example, a color developing solutions, fixing solution and stabilizing solution stored therein, a drying unit 32, a discharging unit 33, etc. The photosensitive material sheets P are sequentially introduced into the processing solutions in the tanks 31 to be developed. The photosensitive material sheets P developed in the development station 30 are then brought into a drying unit 32 to be dried, and the dried photosensitive material sheets P (i.e., pictures) are discharged from the discharging unit 33.

The photosensitive material sheets discharged from the discharging unit 33 are sorted and transferred to collecting sites according to a size, order, etc. of the photosensitive material sheets.

Figure 2:
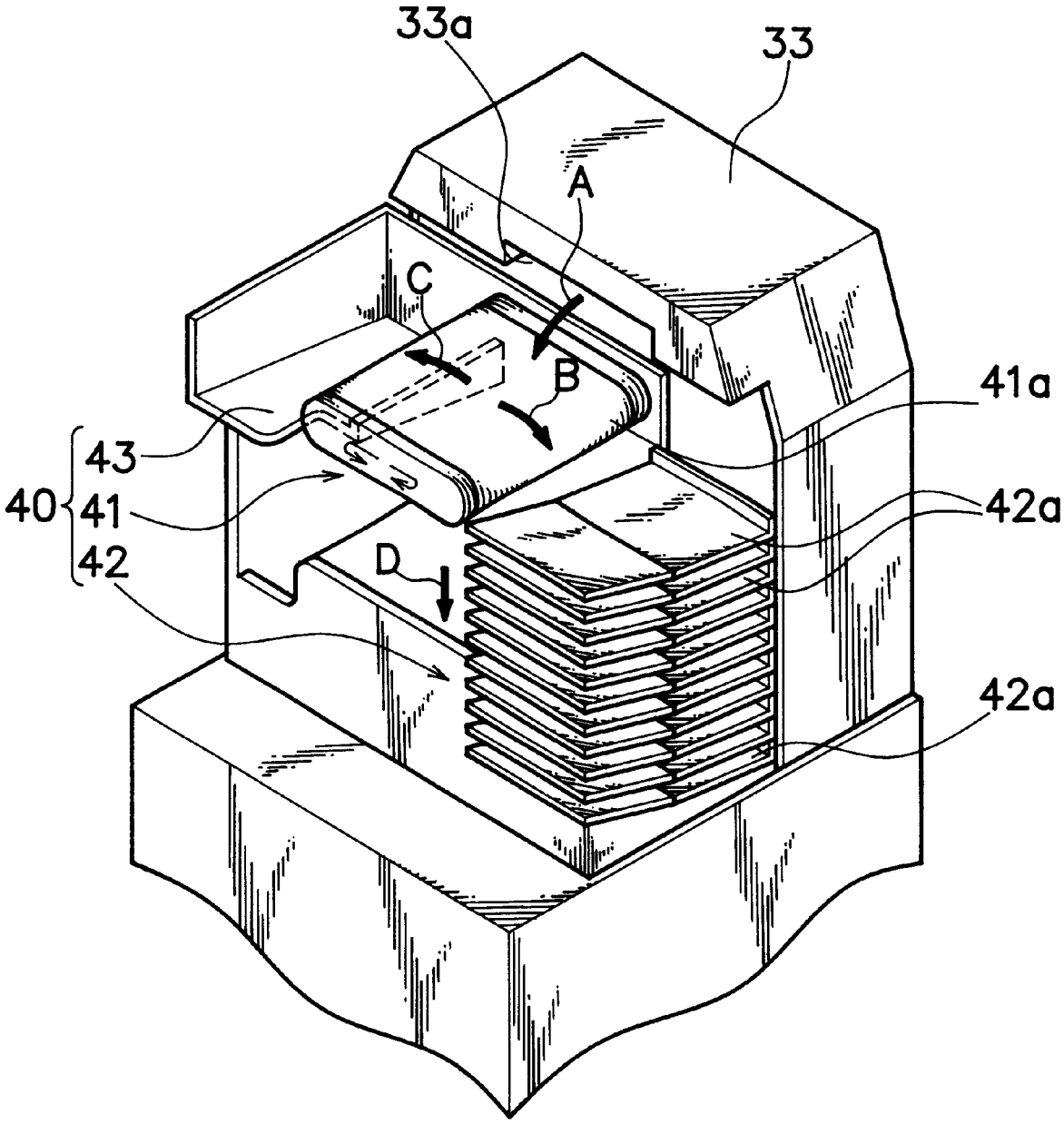
FIG. 2 is a schematic perspective view of the transfer apparatus and its periphery according to an embodiment of the present invention.

FIG. 2 is a schematic perspective view of the transfer apparatus and its periphery attached on the photographic processing apparatus of FIG. 1, in which a transfer apparatus 40 includes a transfer unit 41, a first collecting unit 42 and a second collecting unit 43. The transfer unit 41 includes a belt conveyor 41*a* and a driving means (not shown) in the form of, for example, a DC motor for driving the belt conveyor 41*a* to be rotated in the forward and reverse directions. The first collecting unit 42 is provided in a first collecting site positioned at a side of the belt conveyor 41*a*, and includes a plurality of trays 42*a*, which are rotatable around a horizontal axis, enabling each tray 42*a* to be successively introduced into a sheet-receiving position, to which the sorted photosensitive material sheets are transferred by the belt conveyor 41*a*. The second collecting unit 43 in the form of a large stock box is provided in a second collecting site positioned at another side of the belt conveyor 41*a* so as to receive the sorted photosensitive material sheets from the belt conveyor 41*a*.

In this embodiment, each of the trays 42*a* in the first collecting unit 42 is sized to accommodate the photosensitive material sheets of a smaller size having a width of not more than 102 mm (4 inches), while the second collecting unit 43 is sized to accommodate the photosensitive material sheets of a larger size having a width between 127 mm (5 inches) and 210 mm (8.25 inches).

Next, the operational step of the transfer apparatus 40 according to the above arrangement will be described.

According to the photographic processing apparatus equipped with the transfer apparatus 40 of FIGS. 1 and 2, the dried photosensitive material sheets are discharged from the outlet 33*a* of the discharging unit 33, and moved onto the transfer unit 41 in the direction of arrow A. A plurality of sensors (not shown) are disposed inside of the photographic processing apparatus to detect the size of each photosensitive material sheet to be discharged. The detected information is sent to a control means (not shown) to determine if each of the detected photosensitive material sheets is the smaller size or large size, and control the DC motor as the driving means of the transfer unit 41 to selectively shift the rotational direction of the belt conveyor 41*a*.

Specifically, the control means controls the DC motor so as to selectively shift the direction of the drive of the motor by reversing the current to the motor via a switching means, etc., according to the detected information sent from the sensors, thereby rotating the belt conveyor 41*a* in the direction of arrow B so as to transfer the photosensitive material sheets of the smaller size placed on the belt conveyor 41*a* to the first collecting unit 42, and rotating the belt conveyor 41*a* in the direction of arrow C so as to transfer those of the larger size to the second collecting unit 43.

It is to be noted that the driving means and the shifting operation of the drive of the driving means are not limited to this embodiment. Various driving means can be employed, and accordingly the shifting operation can be accomplished in various methods.

The photosensitive material sheets in one order transferred to the first collecting unit 42 are basically collected on one tray 42*a*. The plurality of trays 42*a* are therefore moved or rotated in the direction of arrow D so as to introduce a different tray 42*a* into the sheet-receiving position for another order, when the photosensitive material sheets for one order has been collected on one tray 42*a*. The stack height of each tray 42*a* is usually set to a predetermined amount, for example the height corresponding to fifty photosensitive material sheets. Therefore, if an order exceeds fifty photosensitive material sheets, the photosensitive material sheets for that order can be stacked on two or more trays 42*a*.

As described above, the second collecting unit 43 in the form of a large stock box accommodates the photosensitive material sheets of the larger size. However, the second collecting unit 43 is not limited to the stock box, as described in this embodiment. Instead, a plurality of trays may be employed, as in the first collecting unit 42, provided that each of the trays is sized to accommodate the photosensitive material sheets of the larger size.

Since the transfer apparatus of this embodiment, which can sort the photosensitive material sheets only by shifting the transfer direction of the belt conveyor, is provided outside of the outlet, an additional outlet for discharging the photosensitive material sheets of a different size can be omitted, even in the case where the photosensitive material sheets are to be transferred in two directions, or sorted either to the first collecting site or the second collecting site.

Further, the transfer apparatus of this embodiment can omit the necessity to provide a sorting mechanism inside of the photographic processing apparatus for sorting the photosensitive material sheets and directing the same to different outlets. This arrangement can simplify the photographic processing apparatus in structure and prevent the chance of the photosensitive material sheets being "chewed up" during the sorting operation.

Accordingly, the transfer apparatus of this embodiment can accomplish the sorting of the photosensitive material sheets according to the size, order, etc., thereof, with a relatively simple structure, which results in a relatively simplified structure of the photographic processing apparatus and a reduction of the manufacturing costs of the photographic processing apparatus, as well as the prevention of the chance of the photosensitive material sheets being chewed up.

In this embodiment, the photosensitive material sheets are properly sorted and transferred according to the detected size thereof Specifically, the photosensitive material sheets having a width of not more than 102 mm (4 inches) are determined as the smaller size, while those having a width of not less than 127 mm (5 inches) are determined as the larger size. It is a matter of course that the threshold size of the photosensitive material sheets can be varied. For example, the photosensitive material sheets having a width of not more than 127 mm (5 inches) may be determined as the smaller size, while those having a width larger than that width may be determined as the larger size.

In this embodiment, the transfer direction of the transfer unit or the belt conveyor is shifted according to the size of the dried photosensitive material sheets. However, the present invention is not limited to this embodiment. For example, the transfer direction of the transfer unit may be shifted according to the order of the photosensitive material sheets.

Figure 3:
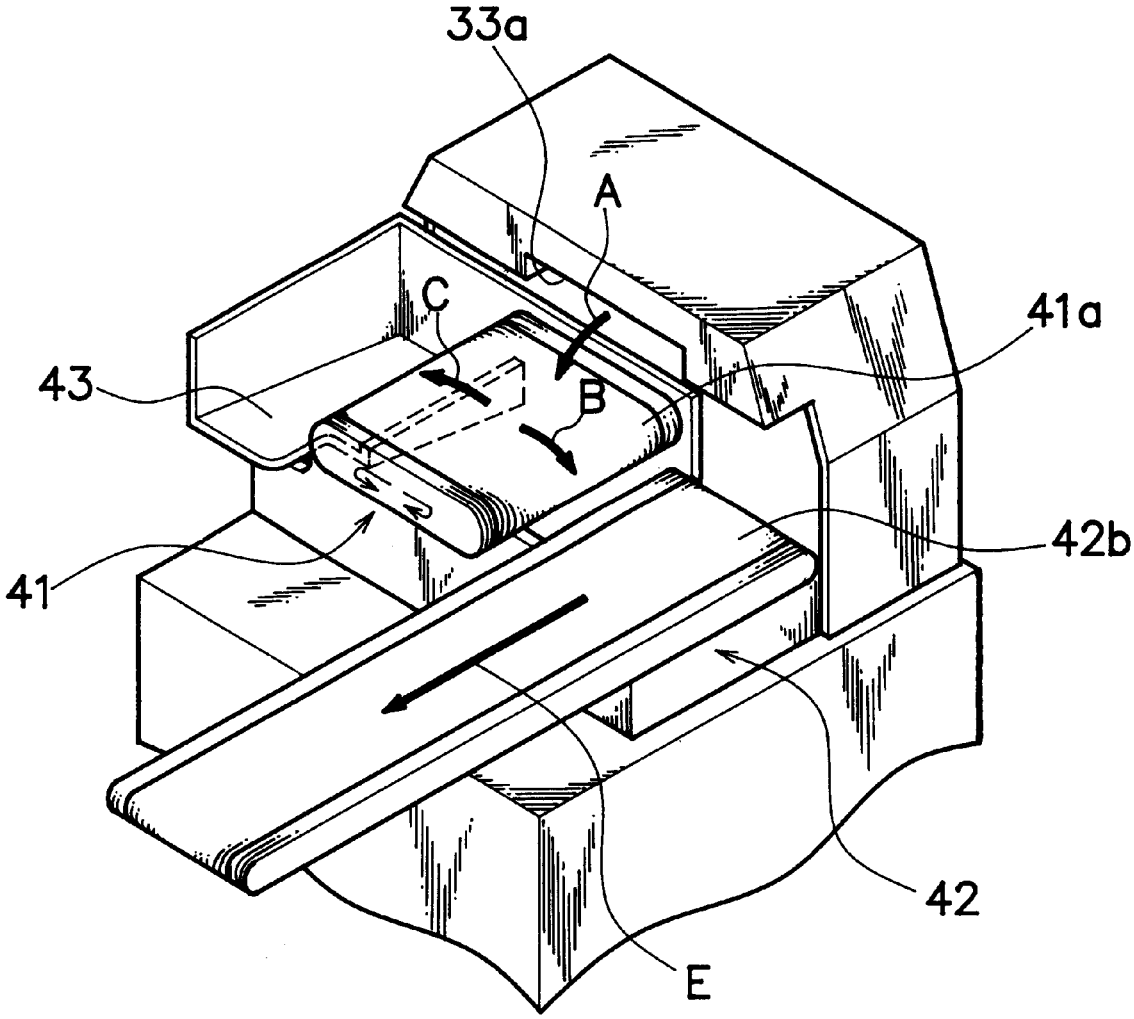
FIG. 3 is a schematic perspective view of the transfer apparatus and its periphery according to another embodiment of the present invention.

The first collecting unit 42 is not limited to the plurality of trays 42*a*, which are rotatable around the horizontal axis. Alternatively, the first collecting unit 42 may be formed by a belt conveyor 42*b*, as illustrated in FIG. 3. The photosensitive material sheets of the smaller size, which are discharged from the outlet 33*a* onto the transfer unit 41, are transferred to the first collecting unit 42 by actuating the driving means so as to rotate the belt conveyor 42*b* in the direction of arrow B, while those of the larger size are transferred to the second collecting unit 43 by actuating the driving means so as to rotate the belt conveyor 42*b* in the direction of arrow C.

The photosensitive material sheets of the smaller size in one order are basically placed on one stacking portion on the belt conveyor 42*b*. The belt conveyor 42*b* is therefore rotated in the direction E by a predetermined distance so as to introduce a new stacking portion into the sheet-receiving position for the next order of the photosensitive material sheets, when the photosensitive material sheets for one order has been stacked on one stacking portion. Thus, the belt conveyor is intermittently rotated to successively introduce different stacking portions into the sheet-receiving position. As described above, if an order exceeds a predetermined stack height, for example the height corresponding to 50 sheets, the photosensitive material sheets for that order can be collected on two or more stacking portions of the belt conveyor 42*b*.

The second collecting unit 43 may be formed by a belt conveyor in the similar manner as that of the first collecting unit, as illustrated in FIG. 3.

Figure 4:
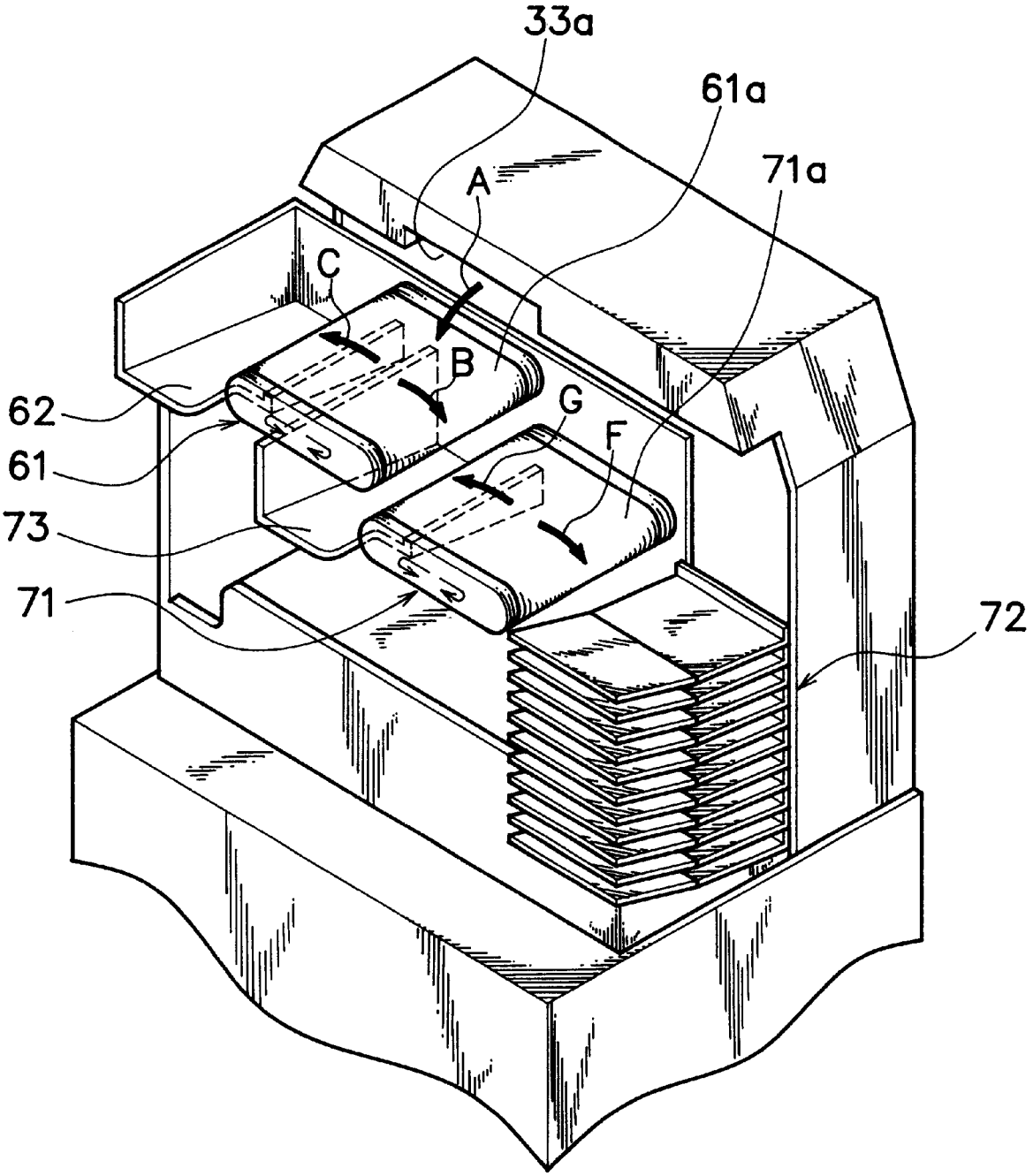
FIG. 4 is a schematic perspective view of the transfer apparatus and its periphery according to still another embodiment of the present invention.
Figure 5:
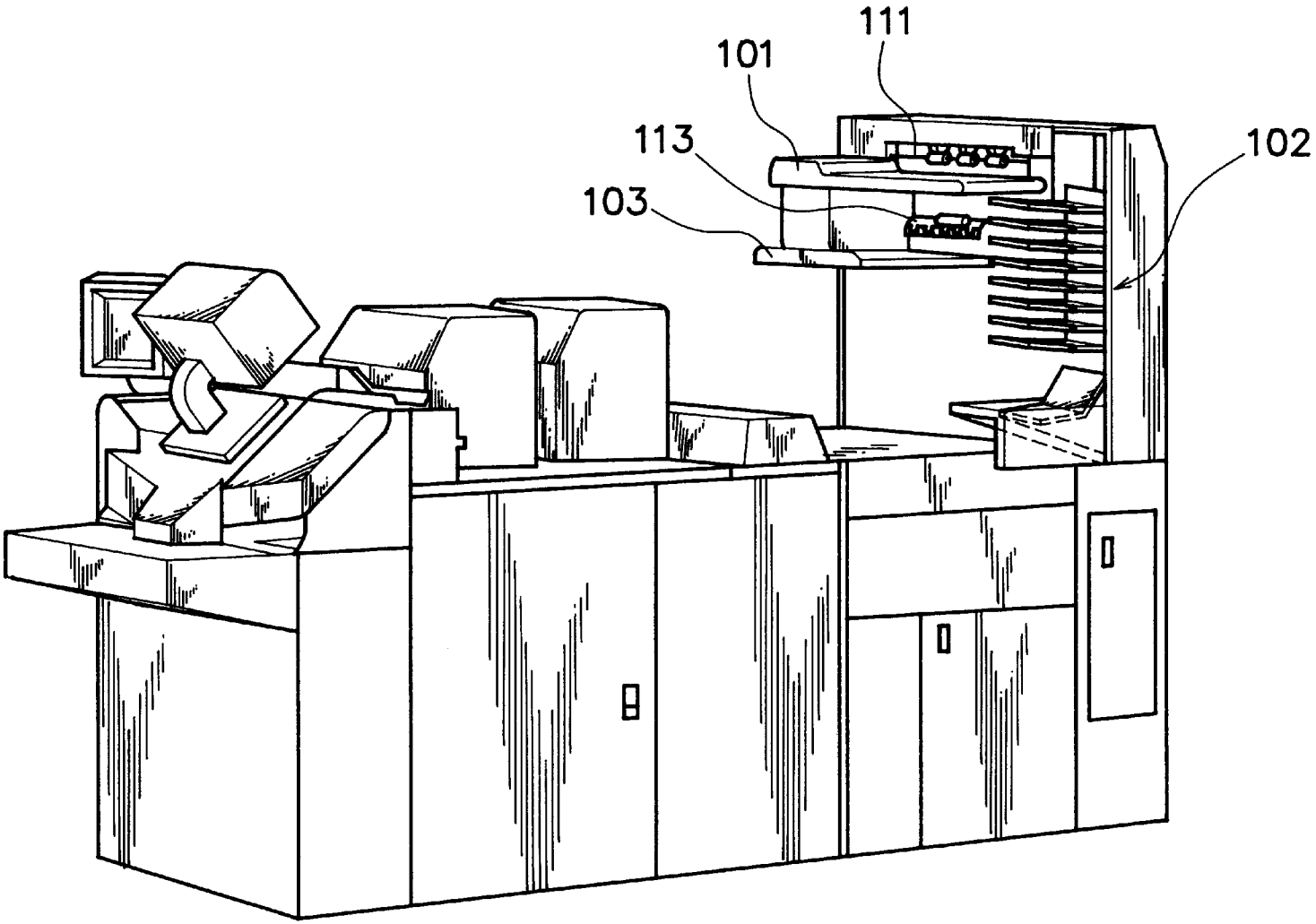
FIG. 5 PRIOR ART
FIG. 5 is a schematic perspective view of a photographic processing apparatus with a conventional transfer apparatus.
Figure 6:
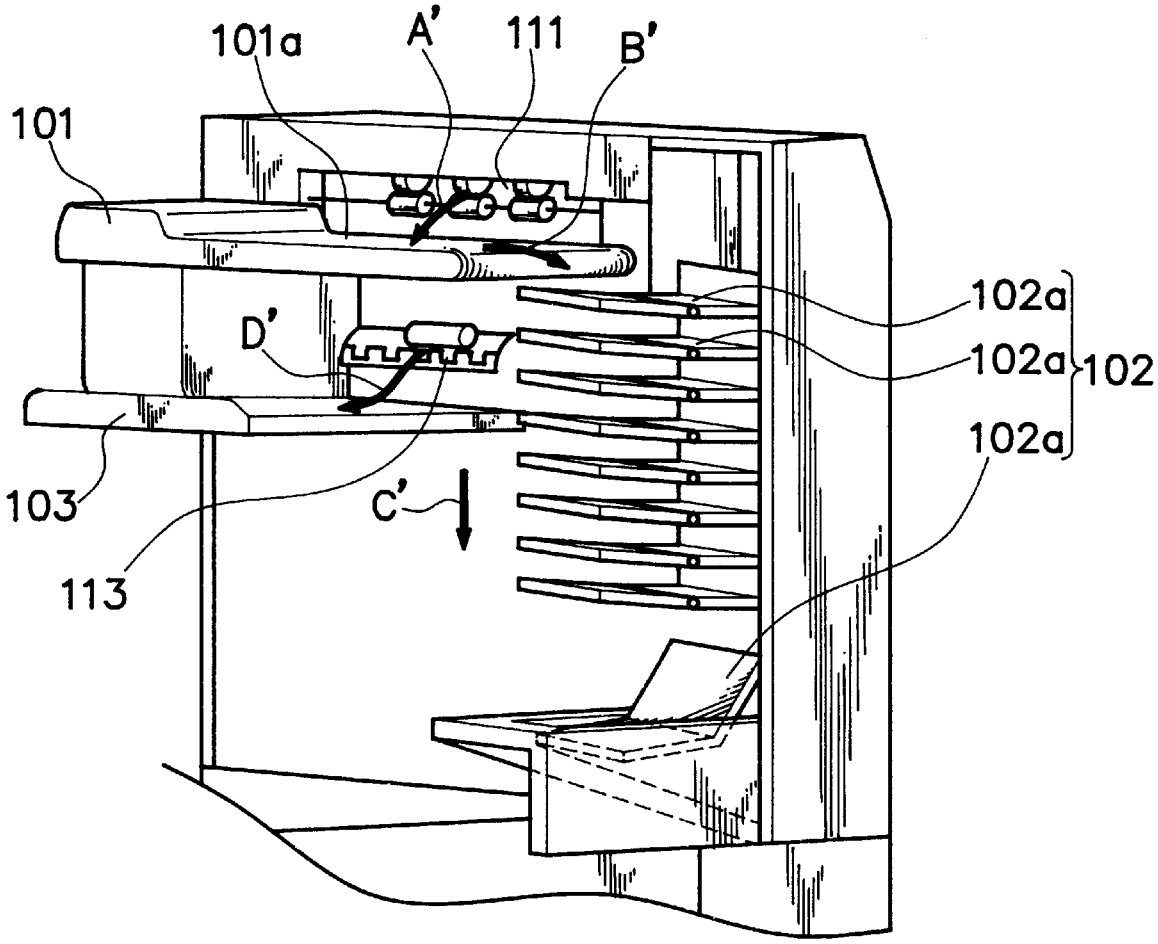
FIG. 6 PRIOR ART
FIG. 6 is a schematic perspective view of the conventional transfer apparatus of FIG. 5 and its periphery.

Although the photosensitive material sheets are sorted and transferred to two collecting sites by shifting the transfer direction of the transfer unit 41 in the form of the belt conveyor 41*a* according to the above embodiment, they can be sorted and transferred to three or more than three collecting sites. One embodiment of the apparatus enabling such sorting and transferring is illustrated in FIG. 4, in which two transfer units are provided at two stages, and respectively controlled so as to shift the transfer directions of the transfer units. This arrangement enables the photosensitive material sheets to be collected in three collecting sites. More specific arrangement will be described below.

As illustrated in FIG. 4, the transfer apparatus includes a first transfer unit 61 and a second transfer unit 71, which are respectively in the form of belt conveyors and capable of selectively shifting their transfer directions by controlling the driving means in the form of, for example, a DC motor according to the detected size, order, etc., of the photosensitive material sheets, as described in the first embodiment. The second transfer unit 71 is located downstream of the first transfer unit 61, so that the photosensitive material sheets transferred to a side of the first transfer unit 61 fall onto the second transfer unit 71.

A first collecting unit 62 is located at a side of the first transfer unit 61, which is opposite to the side, from which the photosensitive material sheets fall onto the second transfer unit 71. Second and third collecting units 72 and 73 are respectively located at both sides of the second transfer unit 71, so that the photosensitive material sheets fallen onto the second transfer unit 71 are brought onto these collecting units.

According to the apparatus of the above arrangement, the size of the photosensitive material sheets are detected by the sensors and the detected information is sent to the control means so as to control the driving means to selectively shift the transfer direction of each of the transfer units according to the size of the photosensitive material sheets placed on the transfer units. When the photosensitive material sheets are to be collected in the first collecting unit 61, the control means controls the driving means to shift the direction of the drive so as to rotate the first transfer unit 61 in the direction of arrow C. When the photosensitive material sheets are to be collected in the second collecting unit 72, the first transfer unit 61 is rotated in the direction of arrow B to cause the transferred photosensitive material sheets to fall from the side of the first transfer unit 61 onto the second transfer unit 71, which is then rotated in the direction of arrow F to transfer them to the second collecting unit 72. When the photosensitive material sheets are to be collected in the third collecting unit 73, those fallen onto the second transfer unit 71 in the same manner as described above are transferred to the third collecting unit 73 by rotating the second transfer unit 71 in the direction of arrow G. Thus, the photosensitive material sheets are properly collected at those collecting sites.

The collecting units of this embodiment may employ various forms, such as a plurality of trays employed for the second collecting unit 72, and a stock box employed for the first and third collecting units 62 and 73.

The number of the collecting sites can be increased by increasing the number of the transfer units, or form the transfer unit into various forms, such as a turn table (not shown) which is located outside of the outlet for receiving the photosensitive material sheets thereon, and a plurality of collecting units are arranged around the turn table.

In the above embodiments, the belt conveyors as the transfer units are arranged at plural stages, so that the photosensitive material sheets fall from one of the belt conveyors onto an adjacent belt conveyor located downstream of the one of the belt conveyors by gravity. This transfer between the adjacent belt conveyors may forcibly be accomplished by using any conventional devices such as feeding rollers, which omit the necessity to sequentially arrange the transfer units from the higher portion to the lower portion.

In the above embodiments, the transfer apparatus has been described as being used together with the photographic processing apparatus, and therefore described as the apparatus designed to transfer the photosensitive material sheets. However, the transfer apparatus of the present invention is not applied only to the photographic processing apparatus, but also applied to a copying apparatus and other sheet material processing apparatuses.

This specification is by no means intended to restrict the present invention to the preferred embodiments set forth therein. Various modifications to the transfer apparatus and the photographic processing apparatus using the same, as described herein, may be made by those skilled in the art without departing from the spirit and scope of the present invention as defined in the appended claims.

What is claimed is:

1. A transfer apparatus for transferring pre-processed sheet materials discharged from an outlet of a sheet processing apparatus comprising a transfer unit provided outside of said outlet for receiving said sheet materials discharged from said outlet and transferring said sheet materials to a plurality of collecting sites located at both sides of said transfer unit, wherein said transfer unit is capable of selectively shifting the transfer direction thereof from the forward direction to the reverse direction or vice versa in such a manner as to transfer each of said sheet materials to a predetermined collecting site of said plurality of collecting sites.

2. A transfer apparatus for transferring pre-processed sheet materials according to claim 1, wherein the transfer direction of said transfer unit can be shifted according to at least one of an order and size of said sheet materials.

3. A transfer apparatus for transferring pre-processed sheet materials discharged from an outlet of a sheet processing apparatus comprising a transfer unit provided outside of said outlet for receiving said sheet materials discharged from said outlet and transferring said sheet materials to a plurality of collecting sites, and said transfer unit including a belt conveyor for transferring said sheet materials to said plurality of collecting sites located at both sides of said belt conveyor, a driving means for driving said belt conveyor to be rotated in the forward and reverse directions, and a control means for controlling said driving means to selectively shift the rotational direction of said belt conveyor, thereby shifting the transfer direction of said transfer unit.

4. An apparatus for transferring pre-processed sheet materials according to claim 3, wherein the transfer direction of said belt conveyor can be shifted according to at least one of an order and size of said sheet materials transfer apparatus for transferring pre-processed sheet materials.

5. A transfer apparatus for transferring pre-processed sheet materials discharged from an outlet of a sheet processing apparatus comprising a transfer unit provided outside of said outlet for receiving said sheet materials discharged from said outlet and transferring said sheet materials to a plurality of collecting sites, and said transfer unit including:

a plurality of belt conveyors arranged at plural stages for transferring said sheet materials discharged from said outlet to said plurality of collecting sites, in which each of said plurality of belt conveyors other than one of said plurality of belt conveyors located at the most downstream position is provided at one side thereof with each of said collecting sites and at another side thereof with an adjacent one of said plurality of belt conveyors located downstream of said each of said plurality of belt conveyors, and said one of said plurality of belt conveyors located at the most downstream position is provided at each side thereof with each of said collecting sites, a driving means for driving said plurality of belt conveyors, and a control means for controlling said driving means to selectively shift the rotational direction of each of said plurality of belt conveyors, thereby allowing each of said plurality of belt conveyors other than said one of said plurality of belt conveyors located at the most downstream position to selectively transfer said sheet materials either to said each of said collecting sites or to said adjacent one of said plurality of belt conveyors located downstream position of said each of said plurality of belt conveyors, and said one of said plurality of belt conveyors located at the most downstream to selectively transfer said sheet materials to either one of said collecting sites located at both sides thereof.

6. A transfer apparatus for transferring pre-processed sheet materials according to claim 5, wherein the transfer direction of each of said belt conveyors can be shifted according to at least one of an order and size of said sheet materials.

7. A transfer apparatus for transferring pre-processed sheet materials discharged from an outlet of a sheet processing apparatus comprising a transfer unit provided outside of said outlet for receiving said sheet materials discharged from said outlet and transferring said sheet materials to a plurality of collecting sites, a plurality of collecting units respectively provided at said plurality of collecting sites, wherein said transfer unit is capable of selectively shifting the transfer direction thereof in such a manner as to transfer each of said the sheet materials to a predetermined collecting site of said plurality of collecting sites.

8. A transfer apparatus for transferring pre-processed sheet materials according to claim 7, wherein the transfer direction of said transfer unit can be shifted according to at least one of an order and size of said sheet materials.

9. A photographic processing apparatus having a drying unit for drying preprocessed photosensitive material sheets and defining an outlet for discharging said photosensitive material sheets dried in said drying unit therethrough comprising a transfer unit provided outside of said outlet for receiving said photosensitive material sheets discharged from said outlet and transferring said photosensitive material sheets to a plurality of collecting sites located at both sides of said transfer unit, wherein said transfer unit is capable of selectively shifting the transfer direction thereof from the forward direction to the reverse direction or vice versa in such a manner as to transfer each of said photosensitive material sheets to a predetermined collecting site of said plurality of collecting sites.

10. A photographic processing apparatus according to claim 9, wherein the transfer direction of said transfer unit can be shifted according to at least one of an order and size of said sheet materials.

11. A photographic processing apparatus having a drying unit for drying preprocessed photosensitive material sheets and defining an outlet for discharging said photosensitive material sheets dried in said drying unit therethrough comprising a transfer unit provided outside of said outlet for receiving said photosensitive material sheets discharged from said outlet and transferring said photosensitive material sheets to a plurality of collecting sites, and said transfer unit including a belt conveyor for transferring said sheet materials to said plurality of collecting sites located at both sides of said belt conveyor, a driving means for driving said belt conveyor to be rotated in the forward and reverse directions, and a control means for controlling said driving means to selectively shift the rotational direction of said belt conveyor, thereby shifting the transfer direction of said transfer unit.

12. A photographic processing apparatus according to claim 11, wherein the transfer direction of said belt conveyor can be shifted according to at least one of an order and size of said sheet materials.

13. A photographic processing apparatus having a drying unit for drying pre-processed photosensitive material sheets and defining an outlet for discharging said photosensitive material sheets dried in said drying unit therethrough comprising a transfer unit provided outside of said outlet for receiving said photosensitive material sheets discharged from said outlet and transferring said photosensitive material sheets to a plurality of collecting sites, and said transfer unit including:

a plurality of belt conveyors arranged at plural stages for transferring said sheet materials discharged from said outlet to said plurality of collecting sites, in which each of said plurality of belt conveyors other than one of said plurality of belt conveyors located at the most downstream position is provided at one side thereof with each of said collecting sites and at another side thereof with an adjacent one of said plurality of belt conveyors located downstream of said belt conveyor, and said one of said plurality of belt conveyors located at the most downstream position is provided at each side thereof with each of said collecting sites, a driving means for driving said plurality of belt conveyors, and a control means for controlling said driving means to selectively shift the rotational direction of each of said plurality of belt conveyors, thereby allowing each of said plurality of belt conveyors other than said one of said plurality of belt conveyors located at the most downstream position to selectively transfer said sheet materials either to said each of said collecting sites or to said adjacent one of said plurality of belt conveyors located downstream position of said each of said plurality of belt conveyors, and said one of said plurality of belt conveyors located at the most downstream to selectively transfer said sheet materials to either one of said collecting sites located at both sides thereof.

14. A photographic processing apparatus according to claim 13, wherein the transfer direction of each of said belt conveyors can be shifted according to at least one of an order and size of said sheet materials.

15. A photographic processing apparatus having a drying unit for drying pre-processed photosensitive material sheets and defining an outlet for discharging said photosensitive material sheets dried in said drying unit therethrough comprising a transfer unit provided outside of said outlet for receiving said photosensitive materials discharged from said outlet and transferring said photosensitive material sheets to a plurality of collecting sites, wherein said transfer unit is capable of selectively shifting the transfer direction thereof in such a manner as to transfer each of said photosensitive material sheets to a predetermined collecting site of said plurality of collecting sites.

16. A photographic processing apparatus according to claim 15, wherein the transfer direction of each said belt conveyors can be shifted according to at least one of an order and size of said sheet materials.

* * * * *